US009636813B2

(12) United States Patent
Rose et al.

(10) Patent No.: US 9,636,813 B2
(45) Date of Patent: May 2, 2017

(54) SPAD SETTING TOOL

(75) Inventors: Douglas L. Rose, Sherman, CT (US); Alan J. Armiento, New Rochelle, NY (US); Robert LaBarbera, New Rochelle, NY (US)

(73) Assignee: BLACK & DECKER INC., New Britain, CT (US)

( * ) Notice: Subject to any disclaimer, the term of this patent is extended or adjusted under 35 U.S.C. 154(b) by 1063 days.

(21) Appl. No.: 13/413,056

(22) Filed: Mar. 6, 2012

(65) Prior Publication Data

US 2013/0233904 A1 Sep. 12, 2013

(51) Int. Cl.
*B25C 1/00* (2006.01)
*B25C 1/18* (2006.01)

(52) U.S. Cl.
CPC ..... *B25C 1/188* (2013.01)

(58) Field of Classification Search
CPC ..... B25C 1/188; B25C 1/184; B25C 3/002; B25C 3/006; B23Q 19/006; B21J 15/32
USPC ..... 227/119, 149
See application file for complete search history.

(56) References Cited

U.S. PATENT DOCUMENTS 2,701,359 A * 2/1955 Asbury ..... B25D 1/00 227/147
3,134,981 A * 6/1964 Demetrakopoulos ... B25C 1/001 227/112
3,171,131 A * 3/1965 De Caro ..... B25C 1/105 227/10
3,250,451 A * 5/1966 Fulop ..... B25C 1/18 227/10
3,306,180 A 2/1967 Asbury
4,252,260 A * 2/1981 Burton ..... B25C 1/00 227/119
4,446,626 A 5/1984 Grender et al.
4,519,536 A * 5/1985 Steigauf ..... B25C 1/00 227/147
5,647,525 A * 7/1997 Ishizawa ..... B25C 1/00 227/113
7,017,790 B1 * 3/2006 Peng ..... B25C 1/188 227/107
7,410,084 B1 8/2008 Reed
8,677,863 B2 * 3/2014 Simon ..... B25C 1/188 227/149
8,777,080 B2 * 7/2014 Draht ..... B21J 15/025 227/119
2008/0054043 A1 * 3/2008 Beales ..... B25C 1/00 227/129
2011/0011912 A1 * 1/2011 Wei ..... B25C 1/00 227/113

(Continued)

OTHER PUBLICATIONS

International Search Report and Written Opinion for PCT Application No. PCT/US2013/028971, dated Jun. 12, 2013, pp. 1-10.

*Primary Examiner* — Andrew M Tecco
(74) *Attorney, Agent, or Firm* — Rhonda L. Barton

(57) ABSTRACT

A spad setting tool includes a housing portion including a spad setting assembly receiver and a trigger. A spad setting assembly is operatively coupled to the housing at the spad setting assembly receiver. The spad setting assembly includes a spad receiving member having a spad receiving zone, and a spad retaining element. The spad retaining element is configured and disposed to retain a spad in the spad receiving zone regardless of an orientation of the spad setting assembly.

14 Claims, 4 Drawing Sheets

(56) References Cited

U.S. PATENT DOCUMENTS

2011/0146455 A1* 6/2011 Simon ..... B23P 19/002
81/44
2011/0290847 A1* 12/2011 Drant ..... B21J 15/025
227/119

* cited by examiner

SPAD SETTING TOOL

BACKGROUND

The present invention pertains to the art of setting tools and, more particularly, to a spad setting tool.

Coal mines are generally dark spaces within which labor numerous people, e.g. coal miners. Generally coal miners employ various types of equipment that require electrical power, air power and the like. Coal miners also require light as well as oxygen to enhance an otherwise harsh working environment. In order to bring electricity, air for tools, and the like to various parts of a coal mine, miners lay cables, conduits, hoses and the like along mine shafts that may stretch for miles underground.

The cables, conduits and the like are generally suspended from wall and/or roof portions of the mine shafts to reduce interactions between miners and mine equipment. Generally the cables, conduits, hoses, and the like are suspended from spads that are driven into the walls and/or ceilings of the mine shafts. Spads are generally triangularly shaped metal members that include an opening for receiving cable ties, wire, and the like. The cable ties or wire are used to retain the cables, conduits, and hoses. Spads are driven into the walls and/or roofs of the mine shaft using a conventional hammer. Typically the hammer is made from brass to reduce sparking.

SUMMARY

In accordance with one aspect of an exemplary embodiment, a spad setting tool includes a housing portion including a spad setting assembly receiver and a trigger. A spad setting assembly is operatively coupled to the housing at the spad setting assembly receiver. The spad setting assembly includes a spad receiving member having a spad receiving zone, and a spad retaining element. The spad retaining element is configured and disposed to retain a spad in the spad receiving zone regardless of an orientation of the spad setting assembly.

In accordance with another aspect of the exemplary embodiment, a spad setting assembly includes a spad receiving member having a spad receiving zone, and a spad retaining element. The spad retaining element is configured and disposed to retain a spad in the spad receiving zone regardless of an orientation of the spad setting assembly.

BRIEF DESCRIPTION OF THE DRAWINGS

Referring now to the drawings wherein like elements are numbered alike in the Figures.

DETAILED DESCRIPTION

Figure 1:
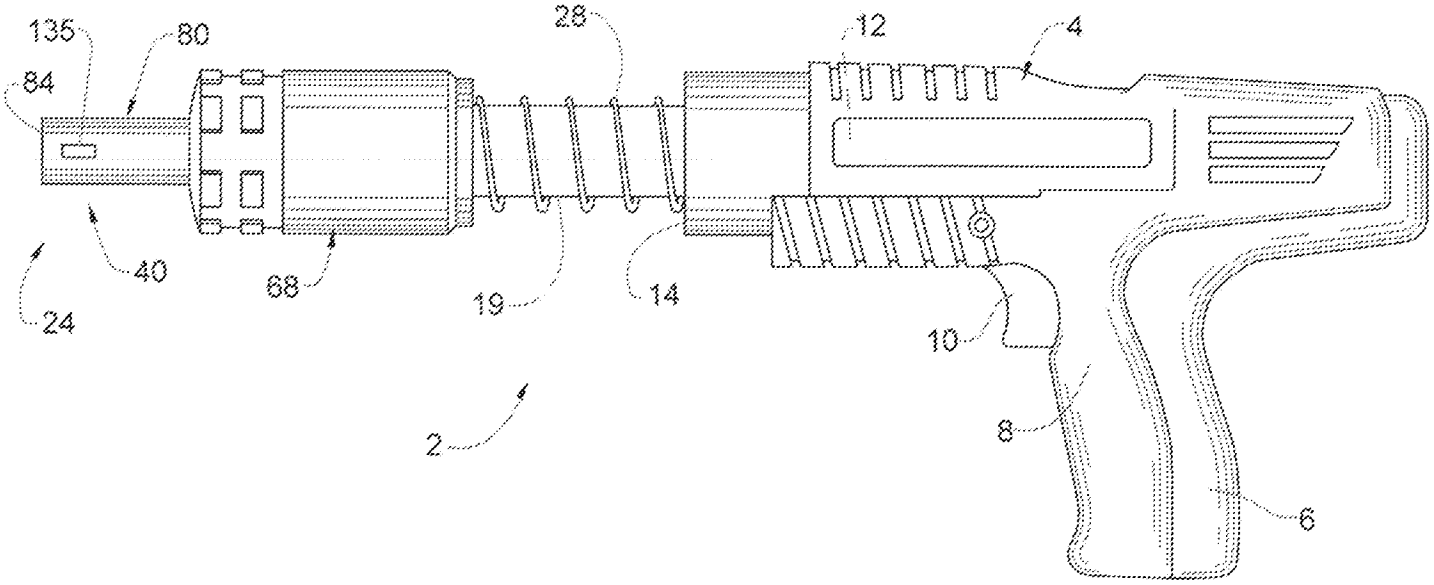
FIG. 1 is a plan view of a spad setting tool having a spad setting assembly in accordance with an exemplary embodiment.

Referring to FIG. 1, a spad setting tool in accordance with an exemplary embodiment is indicated generally at 2. Spad setting tool 2 includes a housing 4 having a hand grip 6 that defines, in part, a trigger housing 8 that supports a trigger 10. Housing 4 also includes a powder charge portion 12 for receiving a powder charge that is selectively detonated to set a spad into a substrate. Spad setting tool 2 is also shown to include a spad setting assembly receiver 14 that supports a piston housing 19 which, it turn, is coupled to a spad setting assembly 24. Piston housing 19 is surrounded by a spring 28. One of ordinary skill in the art will recognize the housing 4 and piston housing 19 form part of a commercially available setting tool Product No. PA351 available from Powers Fasteners, Inc., 2 Powers Lane, Brewster, N.Y. 10509, and therefore does not require explicit discussion. Suffice it to say that setting a spad requires compression of a spring 28 by a user, which is effected by forcing spad setting assembly 24 toward a work surface (not shown). The compression of spring 28 must occur prior to trigger 10 functioning to release a firing pin (not visible in this drawing) to ignite a powder charge (also not visible in this drawing) to expel a spad into the work surface, such as a wall of a coal shaft.

Figure 2:
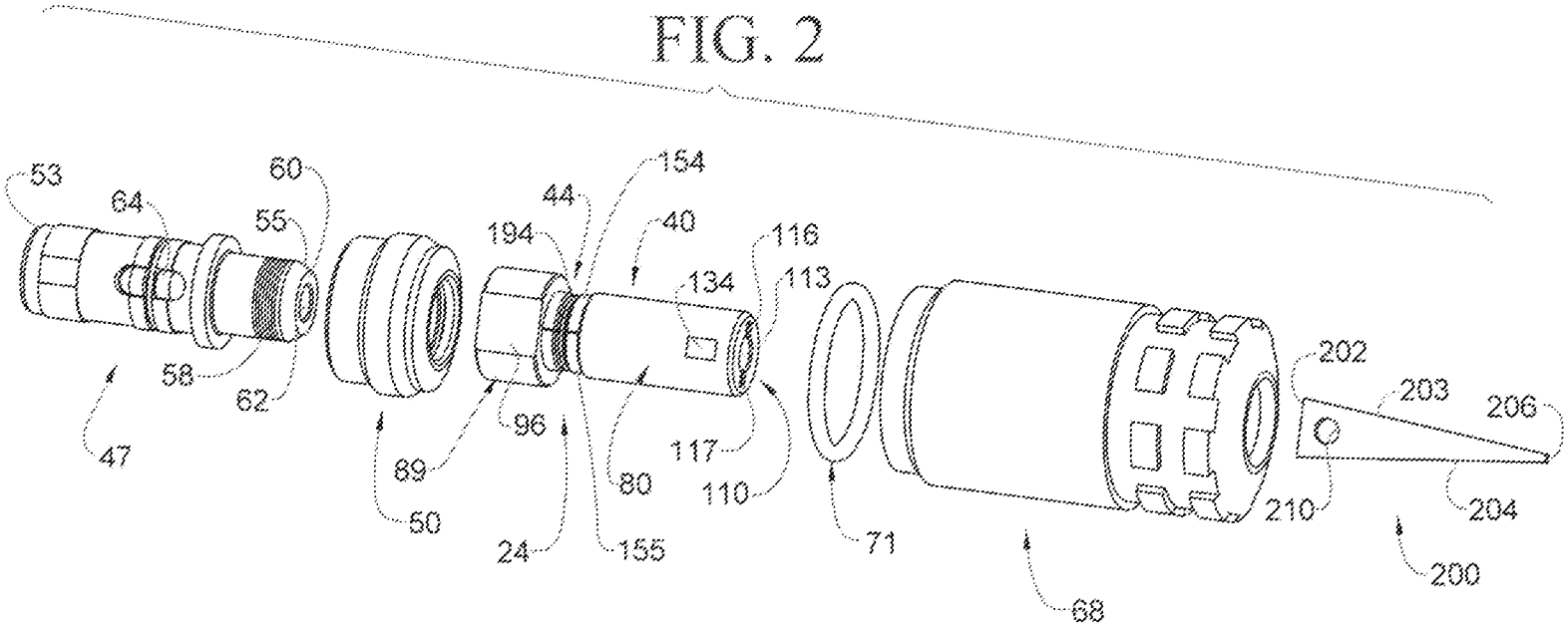
FIG. 2 is an exploded view of the spad setting assembly of FIG. 1.

In accordance with an exemplary embodiment illustrated in FIG. 2, spad setting assembly 24 includes a spad receiving member 40 and a spad retaining element 44. Spad setting assembly 24 is coupled to piston housing 19 through a piston guide 47. A retaining nut 50 extends about spad setting assembly 24 to secure engages with piston housing 19. Retaining nut 50 acts upon piston guide 47 to secure spad setting assembly 24 relative to piston housing 19. Piston guide 47 includes a first end section 53 that extends to a second end section 55. First end section 53 includes a threaded region 58 that is configured to couple with spad receiving member 40. First end section 53 also includes a spad stop surface 60. Piston guide 47 also includes a central passage 62 within which is retained first and second steel balls, one of which is indicated at 64, that facilitate centering a piston (not shown). The piston (not shown) is driven by an explosive force through piston guide 47, is guided between steel balls 64, and extends beyond spad stop surface 60 to drive a spad into the work surface. A dust cover 68 extends over portions of spad setting assembly 24 to reduce ingestion of dust and other particles into piston guide 47. Dust cover 68 is sealed against retaining nut 50 by an O-ring 71. O-ring 71 sits within a groove formed on an inner surface (not shown) of dust cover 68. O-ring 71 is configures to loosely nest upon nut 50. In this manner, dust cover 68 may rotate freely upon nut 50 while at the same time limiting dust ingress to internal portions of spad setting assembly 27.

Figure 3:
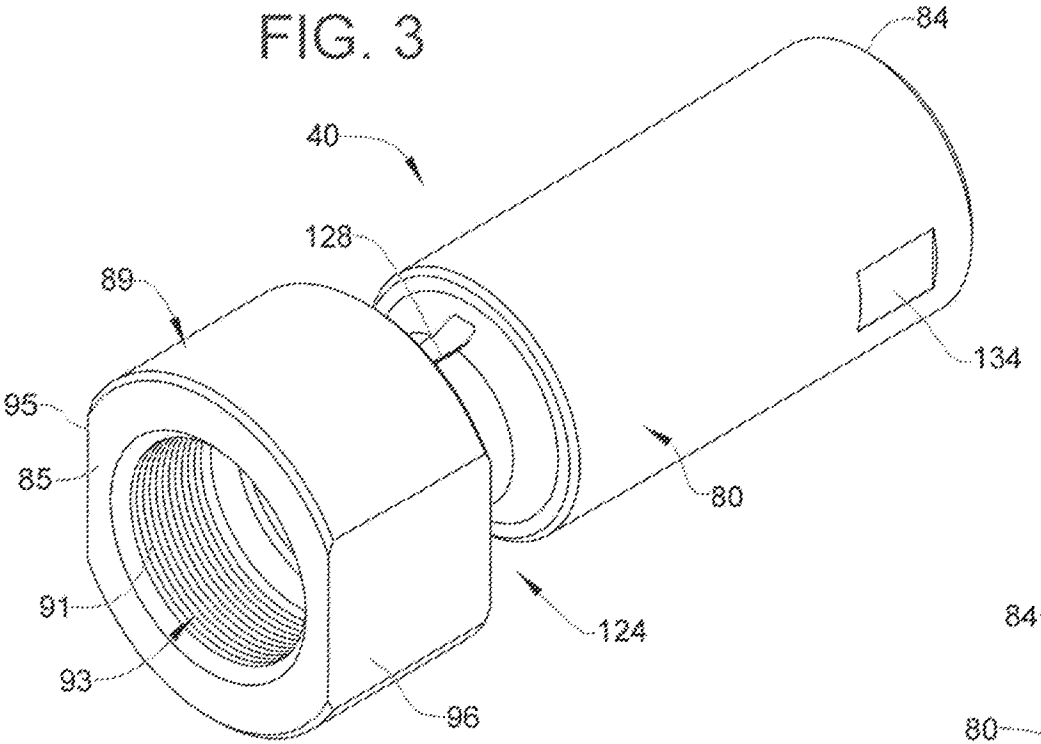
FIG. 3 is a perspective view of a spad receiving member of the spad setting assembly of FIG. 2.
Figure 4:
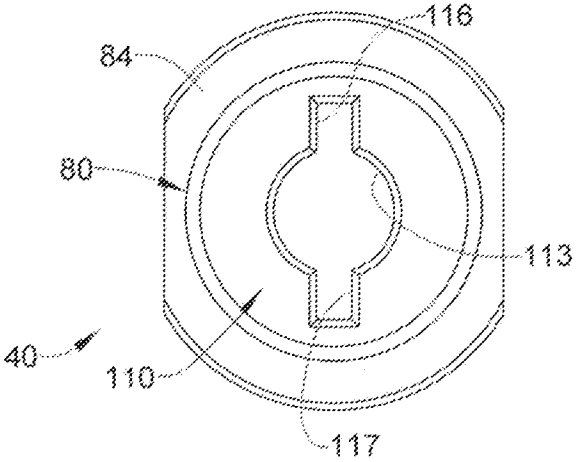
FIG. 4 is an end view of the spad receiving member of FIG. 3.

As seen in FIGS. 3 and 4, spad receiving member 40 includes a body 80 having a first end portion 84 that extends to a second end portion 85. Second end portion 85 includes a piston guide receiving portion 89 having an inner wall surface 91 provided with a plurality of threads 93 that are configured to inter-engage with threaded region 58 on piston guide 47. Piston guide receiving portion 89 also includes first and second opposing flat sections 95 and 96 that are configured to receive a tool, such as a wrench, used to tighten spad receiving member 40 to piston guide 47.

Spad receiving member 40 also includes a spad receiving zone 110. Spad receiving zone 110 includes a central bore 113 formed in body 80. Central bore 113 extends completely through spad receiving member 40 from first end portion 84 to second end portion 85. Spad receiving zone 110 also includes a first spad receiving section 116 that extends radially from central bore 113 into body 80. Spad receiving zone 110 also includes a second spad receiving section 117 that extends radially opposite to first spad receiving section 116 into body 80. First and second spad receiving sections 116 and 117 have a generally rectangular cross-section that is configured to receive a spad. Central bore 113 includes a generally annular cross-section that not only facilitates receipt of a spad, but also allows spad setting tool 2 to set common fasteners.

Spad receiving member 40 is also shown to include a recessed portion 124 formed in body 80 adjacent to piston guide receiving portion 89. Recessed portion 124 includes first and second opposing openings, one of which is shown at 128, that extend into respective ones of first and second spad receiving sections 116 and 117. Spad receiving member 40 is further shown to include first and second orientation members 134 and 135 that provide a user with a tactile feedback of a particular orientation of first and second spad receiving sections 116 and 117 relative to housing 4.

Figure 6:
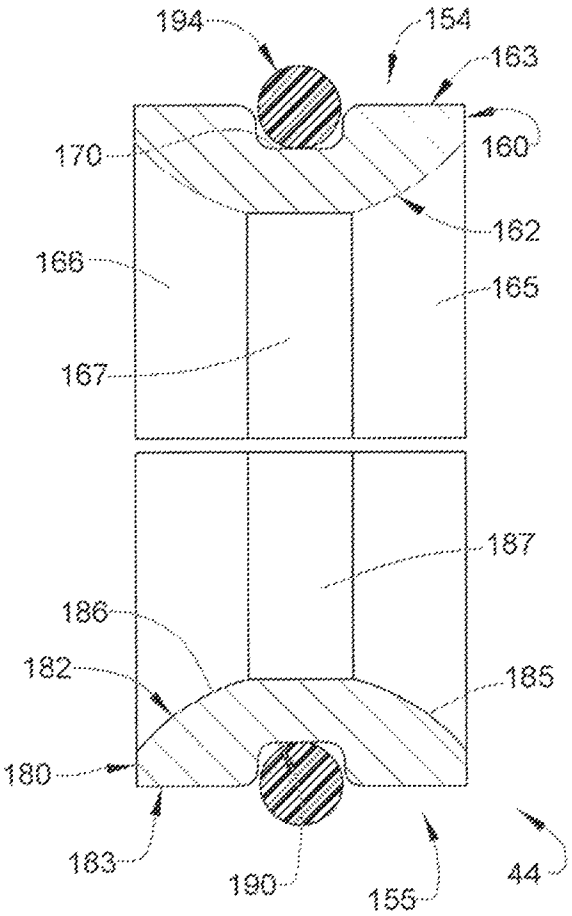
FIG. 6 is a cross-sectional view of the spad retaining element of FIG. 4.
Figure 5:
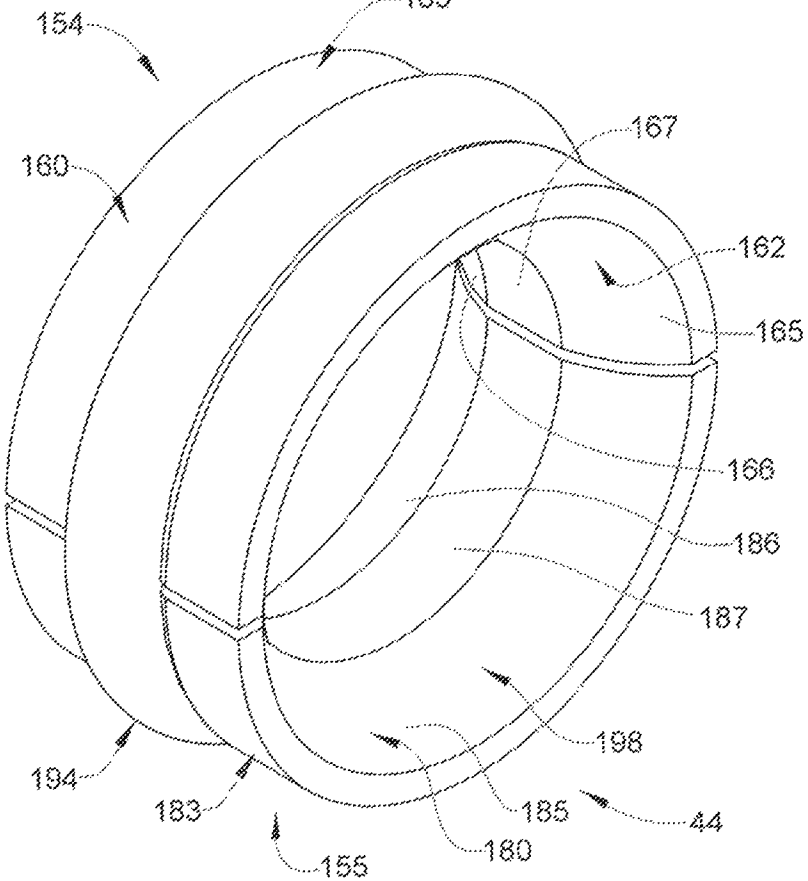
FIG. 5 is a perspective view of a spad retaining element of the spad setting assembly of FIG. 2.

As shown in FIGS. 5 and 6, spad retaining element 44 includes a first spad retaining member 154 and a second spad retaining member 155. First spad retaining member 154 includes a body 160 having an inner surface 162 and an opposing outer surface 163. Inner surface 162 includes a first tapered section 165 and a second tapered section 166 joined through a raised region. Outer surface 163 includes a groove 170. Similarly, second spad retaining member 155 includes a body 180 having an inner surface 182 and an outer surface 183. Inner surface 182 includes a first tapered section 185 and a second tapered section 186 that join through a raised region 187. Outer surface 183 includes a groove 190. First and second spad retaining members 154 and 155 are configured to be aligned one with the other to form an annular band (not separately labeled) with groove 170 aligning with groove 190. At this point, an elastomeric band 194 is seated in grooves 170 and 190 to resiliently join first spad retaining member 154 to second spad retaining member 155. Once joined, raised region 167 registers with raised region 187 to form a reduced diameter portion 198 that is configured to retain a spad. At this point it should be understood that while described as an elastomeric band, other materials including coil springs, spring steel and the like that facilitate expansion and contraction of the first and second spad retaining members could also be employed.

At this point it should be understood that a spad is a type of fastener that is configured for insertion into a substrate such as a wall of a coal mine, concrete block, solid rock, or the like. An exemplary spad is illustrated at 200 in FIG. 1. Spad 200 includes a base section 202 a first angled side 203 and a second angled side 204 that extend from base section 202 and converge at a tip 206. Spad 200 is shown to include an opening 210 that is configured to receive a cable tie, wire or the like that may be used to support a cable, hose or the like on the substrate.

Spad 200 has a generally rectangular cross section that is readily received by spad receiving zone 110 formed in spad receiving member 40. Spad 200 is inserted into spad receiving zone 100, and passes through spad retaining element 44 until base section 202 bottoms out on spad stop surface 60 and portions of angles sides 203 and 204 project through openings 128. First tapered sections 165 and 185 guide spad 200 through spad retaining element 44 causing spad retaining members 154 and 155 to expand, and then contract onto angled sides 203 and 204 through openings 128. In this manner reduced diameter portion 198 is biased toward angled sides 203 and 204 causing spad retaining element 44 to retain spad 200 within spad receiving member 40 regardless of an orientation of spad setting tool 2. Upon being set, second tapered sections 166 and 186 allow spad 200 to pass through reduced diameter portion 198 and exit from spad receiving member 40.

At this point it should be understood that the exemplary embodiments provide a system for retaining and setting a spad into a substrate. The spad setting assembly in accordance with the exemplary embodiment receives and retains a spad regardless of orientation of the setting tool. In addition, the resilient connection of the first and second spad retaining members allows spad setting assembly to readily adapt to a wide range of spad sizes and tapers. Finally the particular configuration of the spad receiving zone in connection with the resilient connection of the spad retaining members allows spad setting assembly to not only receive and set spad, but to also receive and set a variety of standard fasteners. In addition, while described as being employed to set spads having a triangular geometry, the present invention may be employed to set spads having a wide range of geometries, including both simple shapes having generally linear features and complex shapes that combine both linear and curvilinear features. More specifically, the spad receiving portion and, in particular, a geometry of the spad receiving zone may vary in accordance with the exemplary embodiment. In this manner, the spad setting assembly may be readily configured to accommodate a wide range of spad shapes/geometries.

Finally it is to be understood while one or more embodiments have been shown and described, modifications and substitutions may be made thereto without departing from the spirit and scope of the invention. Accordingly, it is to be understood that the present invention has been described by way of illustrations and not limitation.

What is claimed is:

1. A spad setting tool comprising:

a housing including a spad setting assembly receiver and a trigger; and a spad setting assembly operatively coupled to the housing at the spad setting assembly receiver, the spad setting assembly including a spad receiving member having a spad receiving zone, and a spad retaining element, the spad retaining element being configured and disposed to retain a spad in the spad receiving zone regardless of an orientation of the spad setting assembly, wherein the spad retaining element includes a first spad retaining member and a second spad retaining member adjacent to each other, each of the first and second spad retaining members including an outer surface and an inner surface, wherein the spad receiving member includes a body having a first end portion that extends to a second end portion, wherein the spad receiving zone includes a central bore, a first spad receiving section extending from the central bore into the body and a second spad receiving section extending from the central bore into the body opposite to the first spad receiving section, the first and second spad receiving sections defining a pair of slots configured to complement and receive the spad, wherein the inner surface of each of the first and second spad retaining members includes a first tapered section and a second tapered section that join through a raised region, and wherein the outer surface of each of the first and second spad retaining members includes a groove.

2. The spad setting tool according to claim 1, wherein the spad receiving zone extends through the body from the first end portion to the second end portion.

3. The spad setting tool according to claim 1, wherein the spad receiving member includes a recessed portion formed in the body.

4. The spad setting tool according to claim 3, wherein the recessed portion extends annularly about the body adjacent the second end, the recessed portion includes at least one opening that extends to one of the first and second spad receiving sections.

5. The spad setting tool according to claim 4, wherein the spad retaining element nests within the recessed portion.

6. The spad setting tool according to claim 1, wherein the first spad retaining member is resiliently joined to the second spad retaining member by an elastomeric band provided in the groove of each outer surface.

7. The spad setting tool according to claim 1, wherein the first spad retaining member is mated with the second spad retaining member, the raised region of the first spad retaining member registering with the raised region of the second spad retaining member to form a reduced diameter portion.

8. The spad setting tool according to claim 1, wherein the spad receiving member includes an orientation member formed on the body at the first end, the orientation member providing tactile feedback to a user of an orientation of the first and second spad receiving sections relative to the housing of the setting tool.

9. The spad setting tool according to claim 1, wherein the spad receiving member includes a piston guide receiving portion at the second end, the piston guide receiving portion including an inner wall surface provided with a plurality of threads.

10. The spad setting tool according to claim 9, wherein the spad setting assembly includes a piston guide operatively connected to the spad receiving member at the piston guide receiving portion, the piston guide including a central passage that is configured and disposed to align with the central bore, and a spad stop surface.

11. The spad setting tool according to claim 10, wherein the piston guide receiving portion includes first and second opposing flat sections configured and disposed to receive a tool to threadingly engage the piston guide with the spad receiving member.

12. A spad setting assembly comprising:

a spad receiving member having a spad receiving zone, and a spad retaining element, the spad retaining element being configured and disposed to retain a spad in the spad receiving zone regardless of an orientation of the spad setting assembly, wherein the spad receiving member includes a recessed portion and a body having a first end portion that extends to a second end portion, wherein the spad receiving zone includes a central bore, a first spad receiving section extending from the central bore into the body and a second spad receiving section extending from the central bore into the body opposite to the first spad receiving section, the first and second spad receiving sections defining a pair of slots configured to complement and receive the spad, wherein the spad retaining element includes a first spad retaining member and a second spad retaining member that nest within the recessed portion, each of the first and second spad retaining members including an outer surface and an inner surface, the inner surface of each of the first and second spad retaining members includes a first tapered section and a second tapered section that are joined through a raised region, and wherein the first spad retaining member is resiliently joined to the second spad retaining member, the raised region of the first spad retaining member registers with the raised region of the second spad retaining member to form a reduced diameter portion that defines a central spad retaining region.

13. The spad setting assembly according to claim 12, wherein the recessed portion extends annularly about the body adjacent the second end, the recessed portion including at least on opening that extends to one of the first and second spad receiving sections.

14. A spad setting tool comprising:

a housing including a spad setting assembly receiver and a trigger; and a spad setting assembly operatively coupled to the housing at the spad setting assembly receiver, the spad setting assembly including a spad receiving member having a spad receiving zone, and a spad retaining element, the spad retaining element being configured and disposed to retain a spad in the spad receiving zone regardless of an orientation of the spad setting assembly, wherein the spad retaining element includes a first spad retaining member and a second spad retaining member adjacent to each other, each of the first and second spad retaining members including an outer surface and an inner surface, the inner surface of each of the first and second spad retaining members facing each other, wherein the spad receiving member includes a body having a first end portion that extends to a second end portion, and wherein the spad receiving zone includes a central bore, a first spad receiving section extending from the central bore into the body and a second spad receiving section extending from the central bore into the body opposite to the first spad receiving section, the first and second spad receiving sections defining a pair slots configured to complement and receive the spad.

* * * * *